United States Patent [19]

Audeh

[11] Patent Number: 4,514,378

[45] Date of Patent: Apr. 30, 1985

[54] PROCESS FOR RECOVERING URANIUM FROM SPENT SHALE

[75] Inventor: Costandi A. Audeh, Princeton, N.J.

[73] Assignee: Mobil Oil Corporation, New York, N.Y.

[21] Appl. No.: 482,750

[22] Filed: Apr. 7, 1983

[51] Int. Cl.[3] ..... C01G 43/00

[52] U.S. Cl. ..... 423/18; 423/20

[58] Field of Search ..... 423/18, 20

[56] References Cited

U.S. PATENT DOCUMENTS 4,120,934 10/1978 Miöen ..... 423/18

4,374,096 2/1983 Skeaff et al. ..... 423/18 X

FOREIGN PATENT DOCUMENTS 7801145 9/1979 Sweden .

*Primary Examiner*—Edward A. Miller

*Assistant Examiner*—Virginia B. Caress

*Attorney, Agent, or Firm*—Alexander J. McKillop; Michael G. Gilman; Charles A. Malone

[57] ABSTRACT

A process for the recovery of uranium from spent shale by treating the spent shale with a compound selected from the group consisting of methanol, a mixture of methanol and water, and a mixture of methanol and sodium methoxide at between about 240° and 450° C. and atmospheric pressure or higher. The treated spent shale is then leached with an aqueous acid solution such as hydrochloric acid, sulfuric acid, or nitric acid to remove 90% of the uranium from the spent shale and the leached uranium is recovered from the acid solution in a manner known per se.

9 Claims, No Drawings

PROCESS FOR RECOVERING URANIUM FROM SPENT SHALE

FIELD OF THE INVENTION

This invention relates to a process for recovering uranium from spent shale by pretreating the spent shale with a selected compound followed by a leaching operation using an aqueous acid solution to remove the uranium.

BACKGROUND OF THE INVENTION

Uranium is recovered from fresh unretorted oil shale containing uranium by leaching it with hydrochloric, sulfuric or nitric acids. Usually 90% of the uranium is removed. When the same shale is retorted for the recovery of shale oil, the spent shale that results contains the same amount of uranium, however, its concentration increases. This increase is explained by loss of material from the shale without loss of uranium. The uranium left in the spent shale is difficult to remove and only about 40–50% of the uranium can be recovered by leaching with hydrochloric acid.

The present invention provides a process that recovers 90% of the uranium from the spent shale by first treating the spent shale with methanol, methanol and water, or methanol mixed with sodium methoxide at between about 240° and 450° C., either at atmospheric pressure or at higher than atmospheric pressure, followed by leaching with an aqueous acid solution to remove the uranium.

SUMMARY OF THE INVENTION

A process for recovering uranium from spent shale comprising treating the spent shale with an effective amount of a compound selected from the group consisting of methanol, a mixture of methanol and water, and a mixture of methanol mixed with sodium methoxide at a temperature of between about 240° and 450° C. and a pressure of atmospheric or higher, contacting said treated spent shale with a leaching solution comprising an aqueous acid solution to remove uranium from said spent shale, and recovering uranium from said leaching solution. Suitable acids for the leaching operation include hydrochloric, sulfuric, and nitric.

DESCRIPTION OF THE PREFERRED EMBODIMENT

This process of the instant invention is a process for the treatment of spent shale to enable 90% of the uranium to be removed by a leaching operation.

Spent shale obtained by retorting and containing uranium is treated with an effective amount of a compound selected from the group consisting of methanol, a mixture of methanol and water, and a mixture of methanol and sodium methoxide at a temperature of between about 240° and 450° C. and atmospheric pressure or higher. Preferably, the mixture of methanol and water contains about 50 to 85% water and the mixture of methanol and sodium methoxide contains 15% sodium methoxide. Preferably the temperature is between 300° and 400° C., most preferably 350° C. The quantity of the compound used is preferably that amount necessary to saturate the spent shale.

Thereafter, the treated spent shale is leached with an aqueous acid solution selected from the group consisting of hydrochloric acid, sulfuric acid, and nitric acid, wherein 90% of the uranium is removed from the spent shale. The preferred leaching solution is aqueous hydrochloric acid or 5N hydrochloric acid. Uranium is recovered from the solution formed during the leaching operation by known separation techniques such as extraction and precipitation.

The following examples will serve to further illustrate the present invention but are expressly intended not to limit it thereto.

EXAMPLE 1

A sample of fresh shale is treated with 5N hydrochloric acid. About 90% of the 70 ppm of the uranium content of the fresh shale is recovered in the acid solution.

EXAMPLE 2

An aliquot of spent shale obtained by retorting a sample of the same shale used in Example 1 is treated in the same manner used in Example 1. Only 40% of the uranium, based on the fresh shale concentration, is recovered in the acid solution.

EXAMPLE 3

An aliquot of same spent shale used in Example 2 is treated at atmospheric pressure and at 350° C. with methanol and then treated with acid as described in Examples 1 and 2. About 90% of the uranium, based on the fresh shale concentration, is recovered in the acid solution.

EXAMPLE 4

Repeat of Example 3, however, the methanol treating step was carried out at 1700 psig, resulting with the same 90% uranium recovery.

EXAMPLE 5

Repeat of Example 3, however, a 50/50 mixture of methanol/water was used, resulting with the same 90% uranium recovery.

EXAMPLE 6

Repeat of Example 5, however, a pressure of 2250 psig was used, resulting with the same 90% uranium recovery.

From the foregoing specification one skilled in the art can readily ascertain the essential features of this invention and without departing from the spirit and scope thereof can adapt it to various diverse applications. It is my intention and desire that my invention be limited only by those restrictions or limitations as are contained in the claims appended immediately hereinafter below.

What is claimed is:

1. A process for recovering uranium from spent shale comprising:

(a) treating the spent shale with an effective amount of a compound selected from the group consisting of methanol, a mixture of methanol and water, and a mixture of methanol mixed with sodium methoxide at a temperature of between about 240° and 450° C. and a pressure of atmospheric or higher;

(b) leaching the treated spent shale with an aqueous acid solution so as to dissolve uranium from the spent shale; and (c) recovering uranium from the leaching solution.

2. The process of claim 1 wherein the acid in the leaching solution is selected from the group consisting of hydrochloric acid, sulfuric acid, and nitric acid.

3. The process of claim 1 wherein the leaching solution is aqueous hydrochloric acid.

4. The process of claim 1 wherein the leaching solution is 5N hydrochloric acid.

5. The process of claim 1 wherein 90% of the uranium is recovered from the spent shale.

6. The process of claim 1 wherein the mixture of methanol and water used to treat the spent shale during step (a) contains 50 to 85% water.

7. The method of claim 1 wherein the mixture o methanol and sodium methoxide used to treat the spen shale during step (a) contains 15% sodium methoxide.

8. The method of claim 1 wherein the uranium i recovered from the leaching solution by extraction anc precipitation.

9. The process of claim 1 wherein the temperature i between 300° and 400° C.

* * * * *